US005830241A

United States Patent [19]

Rohringer et al.

[11] Patent Number: 5,830,241

[45] Date of Patent: Nov. 3, 1998

[54] FLUORESCENT WHITENING AGENT FORMULATION

[75] Inventors: Peter Rohringer, Schönenbuch, Switzerland; Marc Roger Grienenberger, Bartenheim, France

[73] Assignee: Ciba Specialty Chemicals Corporation, Tarrytown, N.Y.

[21] Appl. No.: 844,821

[22] Filed: Apr. 22, 1997

Related U.S. Application Data

[63] Continuation of Ser. No. 548,636, Oct. 26, 1995, abandoned.

[30] Foreign Application Priority Data

Nov. 4, 1994 [GB] United Kingdom ..... 9422280

[51] Int. Cl.[6] ..... D06P 1/60; D06P 1/613

[52] U.S. Cl. ..... 8/552; 8/611; 8/648; 8/680; 8/919

[58] Field of Search ..... 8/490, 552, 611, 8/648, 680, 919; 510/343, 360

[56] References Cited

U.S. PATENT DOCUMENTS

| | | | |
|---|---|---|---|
| 4,169,702 | 10/1979 | Fleck et al. | 8/648 X |
| 4,339,238 | 7/1982 | Fringeli et al. | 8/527 |
| 5,437,818 | 8/1995 | Ehlis et al. . | |

FOREIGN PATENT DOCUMENTS

| | | |
|---|---|---|
| 0032483 | 7/1981 | European Pat. Off. . |
| 0577557 | 1/1994 | European Pat. Off. . |
| 260472 | 10/1994 | New Zealand . |
| 1247934 | 9/1971 | United Kingdom . |
| 1275162 | 5/1972 | United Kingdom . |
| 2076011 | 11/1981 | United Kingdom . |
| 2239026 | 6/1991 | United Kingdom . |
| 2277749 | 11/1994 | United Kingdom . |

*Primary Examiner*—Margaret Einsman
*Attorney, Agent, or Firm*—Kevin T. Mansfield; George R. Dohmann

[57] ABSTRACT

There is described a liquid preparation comprising:

a) 10 to 40 % by weight of the fluorescent whitening agent having the formula:

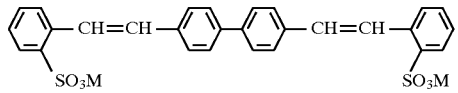

(1)

wherein M is hydrogen, an alkali metal, ammonium or magnesium;

b) 10 to 85% by weight of polyethylene glycol having a mean molecular weight in the range of from 150 to 500;

c) 0 to 75% by weight of water; and d) 0 to 20% by weight of one or more auxiliary compounds; each based on the total weight of the liquid preparation.

The new formulation is suitable for the fluorescent whitening of paper or detergents, and is stable over a wide range of temperature.

14 Claims, No Drawings

FLUORESCENT WHITENING AGENT FORMULATION

This application is a continuation of application Ser. No. 08/548,636, filed on Oct. 26, 1995 now abd.

The present invention relates to a fluorescent whitening agent formulation and, in particular, to such a formulation which is suitable for the fluorescent whitening of paper or detergents and which is stable over a wide range of temperature.

The fluorescent whitening agent having the formula:

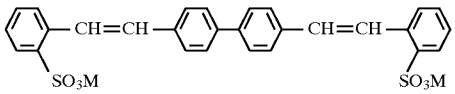

(1)

wherein M is hydrogen, an alkali metal, preferably lithium, sodium or potassium, ammonium or magnesium, as described in GB-A-1 247 934, has proved to be extremely effective in the fluorescent whitening of a wide range of textile fibre materials.

The fluorescent whitening agent having the formula (1) is usually formulated as a liquid in order to facilitate its handling, metering and transportation.

For example, as described in GB-A-1 275 162, the fluorescent whitening agent having the formula (1) has been formulated, for textile treatment, as a preparation comprising a dispersed form of the said fluorescent whitening agent having the formula (1) and an organo-soluble tenside in an organic solvent which can take up a maximum of 1% by weight of water. Preferred solvents are the volatile solvents 1,1,1-trichloroethane, trichloroethylene and perchloroethylene.

These known liquid formulations are disadvantageous in that they are expensive, the use of a hazardous organic solvent is unavoidable and further auxiliaries, such as urea, must be used, moreover in considerable amounts, in order to attain the desired solubility of the fluorescent whitening agent and to control, at least to some extent, the permanent variation in the cold stability of the said liquid formulation.

It has now been found that the disadvantages of known liquid preparations of the fluorescent whitening agent having the formula (1) can be overcome by the use of a specific non-volatile solvent, namely polyethylene glycol. In this way, a liquid preparation of the fluorescent whitening agent having the formula (1) is obtained which is stable on storage at an elevated temperature, e.g., at 50° C.

Accordingly, the present invention provides a liquid preparation comprising:

a) 10 to 40, preferably 20 to 25% by weight of the fluorescent whitening agent having the formula (1);

b) 10 to 85, preferably 20 to 70% by weight of polyethylene glycol having a mean molecular weight in the range of from 150 to 500;

c) 0 to 75, preferably 10 to 30% by weight of water, and d) 0 to 20, preferably 0 to 15% by weight of one or more auxiliary compounds; each based on the total weight of the liquid preparation.

The polyethylene glycol solvent, component b) of the liquid preparation according to the present invention, preferably has a relatively low mean molecular weight, for example a molecular weight in the range of from 200 to 500, in order to obtain a liquid preparation which has a low viscosity and which is pumpable.

While water, the optional component c) of the liquid preparation according to the present invention, is preferably present, in the preferred amounts indicated, the present invention also includes anhydrous liquid preparations.

The fluorescent whitening agent having the formula (1) may be produced, e.g. by the process described in GB-A-1 275 162, followed by purification, using aqueous caustic soda and oxidising agents at elevated temperature.

The formulations according to the present invention can also contain customary formulation auxiliaries, such as dispersing agents, protective colloids, solvents for protective colloids and/or antifreezes, stabilisers, preservatives, perfuming agents and sequestering agents.

Dispersing agents are preferably anionic in character, such as condensation products of aromatic sulfonic acids with formaldehyde, such as ditolylethersulfonic acid, naphthalenesulfonates or ligninsulfonates.

Examples of suitable protective colloids are modified polysaccharides derived from cellulose or heteropolysaccharides, such as xanthan, carboxymethylcellulose, polyvinyl alcohols (PVOH), chitosan or derivatives thereof, starch or derivatives thereof, and aluminium silicates or magnesium silicates.

Examples of solvents for protective colloids and/or antifreezes are ethylene glycol and propylene glycol which are preferably used in an amount of 0.2 to 5% by weight, relative to the total weight of the formulation.

Compounds which may be used as stabilisers are 1,2-benzisothiazolin-3-one, formaldehyde or chloroacetamide, preferably in an amount of 0.1 to 1% by weight, relative to the total weight of the formulation.

Sequestering agents which may be used include ethylenediaminetetraacetic acid and nitrilotriacetic acid.

The formulations according to the present invention may be used, e.g., for the fluorescent whitening of paper or for incorporation into a detergent composition, conveniently by adding the required amount of the liquid preparation according to the present invention to a detergent composition, and then homogenising the mixture so obtained.

When used for the fluorescent whitening of paper, the formulations according to the present invention may be applied to the paper substrate in the form of a paper coating composition or directly in the size press.

In one preferred aspect, the present invention provides a method for the fluorescent whitening of a paper surface, comprising contacting the paper surface with a coating composition comprising a white pigment; a binder dispersion; optionally a water-soluble co-binder; and sufficient of a formulation according to the present invention, to ensure that the treated paper contains 0.01 to 1% by weight, based on the white pigment, of a fluorescent whitening agent having the formula (1).

As the white pigment component of the paper coating composition used according to the method of the present invention, there are preferred inorganic pigments, e.g., aluminium or magnesium silicates, such as China clay and kaolin and, further, barium sulfate, satin white, titanium dioxide, calcium carbonate (chalk) or talcum; as well as white organic pigments.

The paper coating compositions used according to the method of the present invention may contain, as binder, inter alia, plastics dispersions based on copolymers of butadiene/styrene, acrylonitrile/butadiene/styrene, acrylic acid esters, acrylic acid esters/styrene/acrylonitrile, ethylene/vinyl chloride and ethylene/vinyl acetate; or homopolymers, such as polyvinyl chloride, polyvinylidene chloride, polyethylene and polyvinyl acetate or polyurethanes. A preferred binder consists of styrene/butyl acrylate or styrene/butadiene/acrylic acid copolymers or styrene/butadiene rubbers. Other polymer latices are described, for example, in U.S. Pat. Nos. 3,265,654, 3,657,174, 3,547,899 and 3,240,740.

The optional water-soluble protective colloid may be, e.g., soya protein, casein, carboxymethylcellulose, natural or modified starch, chitosan or a derivative thereof or, especially, polyvinyl alcohol. The preferred polyvinyl alcohol protective colloid component may have a wide range of saponification levels and molecular weights; e.g. a saponification level ranging from 40 to 100; and an average molecular weight ranging from 10,000 to 100,000.

Recipes for coating compositions for paper are described, for example, in J. P. Casey "Pulp and Paper"; Chemistry and Chemical Technology, 2nd edition, Volume III, pages 1684–1649 and in "Pulp and Paper Manufacture", 2nd and 5th edition, Volume II, page 497 (McGraw-Hill).

The paper coating compositions used according to the method of the present invention preferably contain 10 to 70% by weight of a white pigment. The binder is preferably used in an amount which is sufficient to make the dry content of polymeric compound up to 1 to 30% by weight, preferably 5 to 25% by weight, of the white pigment. The amount of fluorescent brightener preparation used according to the invention is calculated so that the fluorescent brightener is preferably present in amounts of 0.01 to 1% by weight, more preferably 0.05 to 1% by weight, and especially 0.05 to 0.6% by weight, based on the white pigment.

The paper coating composition used in the method according to the invention can be prepared by mixing the components in any desired sequence at temperature from 10° to 100° C., preferably 20° to 80° C. The components here also include the customary auxiliaries which can be added to regulate the rheological properties, such as viscosity or water retention capacity, of the coating compositions. Such auxiliaries are, for example, natural binders, such as starch, casein, protein or gelatin, cellulose ethers, such as carboxyalkylcellulose or hydroxyalkylcellulose, alginic acid, alginates, polyethylene oxide or polyethylene oxide alkyl ethers, copolymers of ethylene oxide and propylene oxide, polyvinyl alcohol, water-soluble condensation products of formaldehyde with urea or melamine, polyphosphates or polyacrylic acid salts.

The coating composition used according to the method of the present invention is preferably used to produce coated printed or writing paper, or special papers such as cardboard or photographic papers.

The coating composition used according to the method of the invention can be applied to the substrate by any conventional process, for example with an air blade, a coating blade, a roller, a doctor blade or a rod, or in the size press, after which the coatings are dried at paper surface temperatures in the range from 70° to 200° C., preferably 90° to 130° C., to a residual moisture content of 3–8%, for example with infra-red driers and/or hot-air driers. Comparably high degrees of whiteness are thus achieved even at low drying temperatures.

By the use of the method according to the invention, the coatings obtained are distinguished by optimum distribution of the dispersion fluorescent brightener over the entire surface and by an increase in the level of whiteness thereby achieved, by a high fastness to light and to elevated temperature (e.g. stability for 24 hours at 60°–100° C.) and excellent bleed-fastness to water.

In a second preferred aspect, the present invention provides a method for the fluorescent whitening of a paper surface comprising contacting the paper in the size press with an aqueous solution containing a size, optionally an inorganic or organic pigment and 0.1 to 20 g/l of a fluorescent whitening agent having the formula (1). Preferably, the size is starch, a starch derivative or a synthetic sizing agent, especially a water-soluble copolymer.

Further, the aqueous fluorescent whitener formulations used according to the method of the present invention have the following valuable properties: low electrolyte content; low charge density; trouble-free incorporation into coating colours; no interaction with other additives; low interference by cationic auxiliaries; and excellent compatibility with and resistance to oxidising agents and peroxy-containing bleach residues.

The following Examples further illustrate the present invention. Parts and percentages are by weight unless otherwise stated.

EXAMPLES 1 and 2

A) Formation of the Fluorescent Whitener Formulation

By stirring together, at 25° C., the components shown in the following Table 1, the respective aqueous formulations are obtained.

TABLE 1

| Example | % FWA | % PEG 300 | % water | % PVOH |
|---|---|---|---|---|
| — | 24 | 0 | 76 | 0.1 |
| 1 | 24 | 30 | 46 | 0.1 |
| 2 | 24 | 40 | 36 | 0.1 |

In the Table 1, FWA denotes a dispersion of the fluorescent whitening agent having the formula (1), in the hydrate p-form described in EP-A-0 577 557; PEG 300 denotes a commercial polyethylene glycol having a molecular weight of 300; and PVOH denotes a commercial polyvinyl alcohol.

The control formulation (containing no PEG) separates into two phases after storage for 5 hours at 50° C.

By contrast, the formulations according to the invention and containing PEG are pourable and pumpable immediately on formation and remain so even after storage for 5 hours at 50° C.

B) Preparation of the Coating Composition

The following formulation is made up:

20 parts of a commercial clay (Clay SPS);

80 parts of a commercial calcium carbonate (Hydrocarb 90);

18 parts of a commercial 50% dispersion of a styrene/butadiene rubber latex (Dow Latex 955);

0.5 part of a commercial polyvinyl alcohol (Mowiol 4-98);

0.5 part of carboxymethylcellulose (Finnfix 5);

0.3 part of a polycarboxylic acid dispersant(Polysalz S); and 0.5 part of a commercial 65% melamine/formaldehyde precondensate (Protex M3M).

Sufficient of the formulation of Example 1(A) or 2(A) is then added to provide 0.2 part of the fluorescent whitener of formula (1). The content of the dry substance in the coating composition is adjusted to 60% and the pH is adjusted to 9.5 using NaOH.

C) Application of the Coating Composition to Paper

Commercial base paper of LWC (light weight coated) quality having a weight per unit area of 39 g/m$^2$ and a content of mechanical wood pulp of 50%, is coated in a Dow laboratory coater at a blade pressure of 0.48 bar, at an application consistency of 60% at pH 9.2 with a respective aqueous coating composition as shown in Part B).

The respective coated papers are dried at 195° to 200° C. until the moisture content is constant at about 7% by weight, under standard conditions. The coating weight, after acclimatisation (23° C., 50% relative humidity), is 10.0±1.9 g/m$^2$.

D) Application of the Fluorescent Whitener Formulation in the Size Press

Separate samples of an 8% aqueous solution of an anionic starch (Perfectauryl A 4692), respectively containing 4 g/l of the formulation of Example 1 or 2, are applied to each of two separate base papers in the size press, at a 37% pick-up.

The respective treated papers are then dried at 80° C. using hot air.

The first base paper (paper I) used is one which has been sized with 1.5% of commercial rosin size dispersion and alum, resulting in a paper which has a pH of 4.7. The second base paper (paper II) used is one which has been sized with 1.5% of commercial AKD (alkyldiketene) size dispersion and which has a pH of 7.5.

The Ganz Whiteness of each coated paper is determined using a Datacolor measuring device.

The Ganz method is described in detail in the Ciba-Geigy Review, 1973/1, and also in the article "Whiteness Measurement", ISCC Conference on Fluorescence and the Colorimetry of Fluorescent Materials, Williamsburg, February 1972, published in the Journal of Color and Appearance, 1, No.5 (1972).

The results are set out in the following Table 2:

TABLE 2

| | Ganz Whiteness | | |
|---|---|---|---|
| | | size press | |
| Example | coating | paper I | paper II |
| control | 109 | 173 | 189 |
| 1 | 116 | 169 | 184 |
| 2 | 115 | 169 | 188 |

The results in Table 2 demonstrate that the whiteness of the treated paper is not impaired by the method of the present invention when applied in the size press, and is slightly improved when a paper coating technique is used.

EXAMPLES 3 to 5

A) Formation of the Fluorescent Whitener Formulation

By heating together, at about 90° C., until the FWA has completely dissolved, then cooling the solution so obtained, with agitation, until the FWA completely crystallizes out, forming a stable dispersion, the respective compositions shown in the following Table 3 are obtained.

TABLE 3

| Example | % FWA | % PEG 300 | % water | % PVOH |
|---|---|---|---|---|
| 3 | 24 | 50 | 26 | 0.1 |
| 4 | 24 | 60 | 16 | 0.1 |
| 5 | 24 | 66 | 10 | 0.1 |

In Table 3, PEG and PVOH have the same significance as in Table 1 but FWA denotes the pure powdered of the fluorescent whitening agent having the formula (1).

The respective formulations are each pourable and pumpable immediately on formation and remain so even after storage for 5 hours at 50° C.

B) Preparation of the Coating Composition

Using the procedure described in Part B) of Examples 1 and 2, respective coating compositions are prepared from compositions shown in Table 3.

C) Application of the Coating Composition to Paper

Using the procedure described in Part C) of Examples 1 and 2, the same commercial LWC base paper is coated with the respective coating compositions of Part B).

D) Application of the Fluorescent Whitener Formulation in the Size Press

Using the procedure described in Part D) of Examples 1 and 2, the same base papers I and II are treated in the size press with separate samples of an 8% aqueous solution of an anionic starch (Perfectauryl A 4692), respectively containing 4 g/l of the formulation of Examples 3, 4 or 5, in the manner described.

The results obtained are set out in the following Table 4.

TABLE 4

| | Ganz Whiteness | | |
|---|---|---|---|
| | | size press | |
| Example | coating | paper I | paper II |
| control | 109 | 173 | 189 |
| 3 | 119 | 174 | 185 |
| 4 | 119 | 172 | 185 |
| 5 | 115 | 184 | 182 |

The results in Table 4 demonstrate that the whiteness of the treated paper is not impaired by the method of the present invention when applied in the size press, and is slightly improved when a paper coating technique is used.

EXAMPLE 6

When the procedure described in part a) of example 3 is repeated except that the lithium salt of the compound of formula (1) is used instead of the corresponding sodium salt, a pourable and pumpable formulation is obtained immediately on formation and the formulation remains pumpable, even after storage for 5 hours at 50° C.

When the procedure described in parts B), C) and D) of example 3 is repeated using the lithium salt of the compound of formula (1), the respective Ganz Whiteness values obtained are 123 (coating application) and, in the size press, 185 for paper I and 191 for paper II.

we claim:

1. A liquid preparation consisting essentially of a) 10 to 40% by weight of the fluorescent whitening agent having the formula:

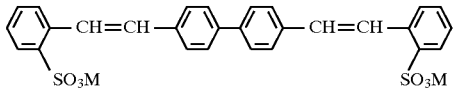

(1)

wherein M is hydrogen, an alkali metal, ammonium or magnesium;

b) 20 to 70% by weight of polyethylene glycol having a mean molecular weight in the range of from 150 to 500;

c) 10 to 30% by weight of water; and d) 0 to 15% by weight in total of one or more auxiliary compounds selected from the group consisting of dispersing agents, protective colloids, solvents for protective colloids, antifreezes, stabilizers, perfuming agents and suquestering agents; each based on the total weight of the liquid preparation.

2. A liquid preparation according to claim 1 comprising:

a) 20 to 25% by weight of the fluorescent whitening agent having the formula (1) wherein M is hydrogen, lithium, sodium or potassium, ammonium or magnesium;

b) 20 to 70% by weight of polyethylene glycol having a mean molecular weight in the range of from 150 to 500;

c) 10 to 30% by weight of water; and d) 0 to 15% by weight of one or more auxiliary compounds; each based on the total weight of the liquid preparation.

3. A liquid preparation according to claim 2 in which M is sodium or lithium.

4. A liquid preparation according to claim 1 in which the polyethylene glycol has a mean molecular weight in the range of from 200 to 500.

5. A liquid preparation according to claim 1 in which the sequestering agents are ethylenediaminetetraacetic acid or nitrilotriacetic acid.

6. A liquid preparation according to claim 1 in which the dispersing agents are anionic in character.

7. A liquid preparation according to claim 6 in which the dispersing agents are condensation products of aromatic sulfonic acids with formaldehyde.

8. A liquid preparation according to claim 7 in which the dispersing agents are ditolylethersulfonic acid, naphthalenesulfonates or ligninsulfonates.

9. A liquid preparation according to claim 1 in which the protective colloids are modified polysaccharides derived from cellulose or heteropolysaccharides, carboxymethylcellulose, polyvinyl alcohols (PVOH), chitosan or derivatives thereof, starch or derivatives thereof, aluminium silicates or magnesium silicates.

10. A liquid preparation according to claim 9 in which the modified polysaccharide is xanthan.

11. A liquid preparation according to claim 1 in which the solvents for protective colloids and/or antifreezes are ethylene glycol or propylene glycol.

12. A liquid preparation according to claim 1 in which the amount of ethylene glycol or propylene glycol is 0.2 to 5% by weight, relative to the total weight of the formulation.

13. A liquid preparation according to claim 1 in which the stabilisers are 1,2-benzisothiazolin-3-one, formaldehyde or chloroacetamide.

14. A liquid preparation according to claim 13 in which the 1,2-benzisothiazolin-3-one, formaldehyde or chloroacetamide are used in an amount. of 0.1 to 1% by weight, relative to the total weight of the formulation.

* * * * *